US006537108B2

(12) United States Patent
Sasaki

(10) Patent No.: US 6,537,108 B2
(45) Date of Patent: Mar. 25, 2003

(54) RETAINING STRUCTURE OF FRONT HOLDER TO CONNECTOR HOUSING

(75) Inventor: Yasuhiro Sasaki, Shizuoka-ken (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 09/962,354

(22) Filed: Sep. 26, 2001

(65) Prior Publication Data

US 2002/0042226 A1 Apr. 11, 2002

(30) Foreign Application Priority Data

Sep. 27, 2000 (JP) ..... 2000-295112

(51) Int. Cl.[7] ..... H01R 13/40
(52) U.S. Cl. ..... 439/595; 439/752
(58) Field of Search ..... 439/595, 752, 439/271

(56) References Cited

U.S. PATENT DOCUMENTS

| | | | | | |
|---|---|---|---|---|---|
| 5,944,558 | A | * | 8/1999 | Iwahori | 439/595 |
| 5,989,066 | A | * | 11/1999 | Cox | 439/595 |
| 6,077,117 | A | * | 6/2000 | Iwahori | 439/595 |
| 6,086,419 | A | * | 7/2000 | Marpoe, Jr. | 439/595 |
| 6,276,964 | B1 | * | 8/2001 | Shinozaki | 439/595 |
| 6,354,867 | B1 | * | 3/2002 | Tachi et al. | 439/488 |

FOREIGN PATENT DOCUMENTS

| | | | |
|---|---|---|---|
| JP | 62-64076 | 3/1987 | H01R/13/42 |
| JP | 63-29864 | 2/1988 | H01R/13/42 |
| JP | 63-39874 | 3/1988 | H01R/13/645 |
| JP | 63-313478 | 12/1988 | H01R/13/42 |
| JP | 8-83648 | 3/1996 | H01R/13/42 |
| JP | 9-219258 | 8/1997 | H01R/13/42 |

* cited by examiner

*Primary Examiner*—Lynn D. Feild
*Assistant Examiner*—Hae Moon Hyeon
(74) *Attorney, Agent, or Firm*—Finnegan, Henderson, Farabow, Garrett & Dunner, L.L.P.

(57) ABSTRACT

A retaining structure of a front holder and a connector housing, essentially consist of a housing body having a retaining portion, a holding arm having a retaining projection, and a flexible connection portion for supporting the holding arm so that the retaining projection can be engaged with the retaining portion, wherein the flexible connection portion supports the holding arm on a front end of the flexible connection portion in an inserting direction of the front holder into a housing body with respect to the retaining projection, the retaining projection is engaged with the retaining portion in a state where the front holder is retained to the housing body. If a force is applied in a direction releasing the engagement between the front holder and the housing body, the retaining projection abuts against the retaining portion so that the holding arm tries to rock in a direction opposite from the direction releasing the engagement. Therefore, the retained state between the front holder and the housing body is maintained.

5 Claims, 7 Drawing Sheets

RETAINING STRUCTURE OF FRONT HOLDER TO CONNECTOR HOUSING

BACKGROUND OF THE INVENTION

1. Field of the Invention

The present invention relates to a structure for retaining, to a connector housing, a front holder in an electric wire connector for preventing a terminal from falling off.

2. Description of the Related Art

There is a connector having a housing body including a terminal accommodating chamber for accommodating a terminal therein, and a front holder for preventing the terminal from falling off from the terminal accommodating chamber. Japanese Patent Application Laid-open No. S62-64076 discloses a structure for retaining the front holder to the housing body.

The front holder includes a pair of or a plurality of resilient retaining portions and resilient pieces, and if they are strongly pushed into the housing body, the resilient retaining portions and the resilient pieces are engaged with hooks on the side of a housing, and the front holder is retained to the housing body.

SUMMARY OF THE INVENTION

If a large external force is applied to the above-described front holder, the resilient pieces are bent and engagement with the corresponding hooks on the side of the housing fails. In order to prevent this, the rigidity of the resilient piece must be enhanced but if so, there is a drawback that further large force is required when the front holder is inserted into the housing body, and the operation becomes extremely difficult. Further, if the rigidity of the resilient piece is increased, it is difficult to release the engagement state, it takes time and labor to detach the front holder from the housing body, and there is an adverse possibility that the hooks for retaining the resilient retaining portions and the resilient pieces are damaged.

Thereupon, it is an object of the present invention to provide a retaining structure of a front holder and a connector housing capable of enhancing the operability for retaining the front holder to the housing body, and easily detaching the front holder from the housing body without damaging the front holder.

According to a first aspect of the present invention, the front holder comprises a housing body having a retaining portion, a holding arm having a retaining projection, and a flexible connection portion for supporting the holding arm so that the retaining projection can be engaged with the retaining portion. If the front holder is inserted into the housing body, the holding arm rocks, the retaining projection climbs over the retaining portion, the retaining projection is engaged with the retaining portion, and the front holder is retained to the housing body. In a state where the front holder is retained to the housing body, if a force is applied in a direction releasing the engagement between the front holder and the housing body, the retaining projection abuts against the retaining portion so that the holding arm tries to rock in a direction opposite from the direction releasing the engagement. Therefore, the retained state between the front holder and the housing body is maintained.

According to a second aspect of the present invention, the retaining projection is formed in a direction perpendicular to the inserting direction of the front holder into the housing body, the retaining projection includes an abutment surface which abuts against the retaining portion in a state where the retaining projection is retained to the retaining portion. In a state where the front holder is retained to the housing body, if a force is applied in a direction releasing the engagement between the front holder and the housing body, the retaining projection abuts against the retaining portion. A third aspect of the present invention includes structures of the first and second aspects, and the retaining projection includes a slide guide inner surface which slides on the retaining portion to guide a rocking motion of the holding arm when the front holder is inserted into the housing body.

When the front holder is inserted into the housing body, the slide guide surface slides along the retaining portion to bend the flexible connection portion, thereby rocking the holding arm.

A fourth aspect of the present invention includes structures of the first to third aspects, and in a state where the front holder is retained to the housing body, a space is formed between the housing body and a rear end of the holding arm in the inserting direction inserting the front holder into the housing body.

In the state where the front holder is retained to the housing body, the jig is inserted into the space to rock the holding arm, and the engagement between the retaining projection and the retaining portion can be released.

DETAILED DESCRIPTION OF THE PREFERRED EMBODIMENT

Figure 1:
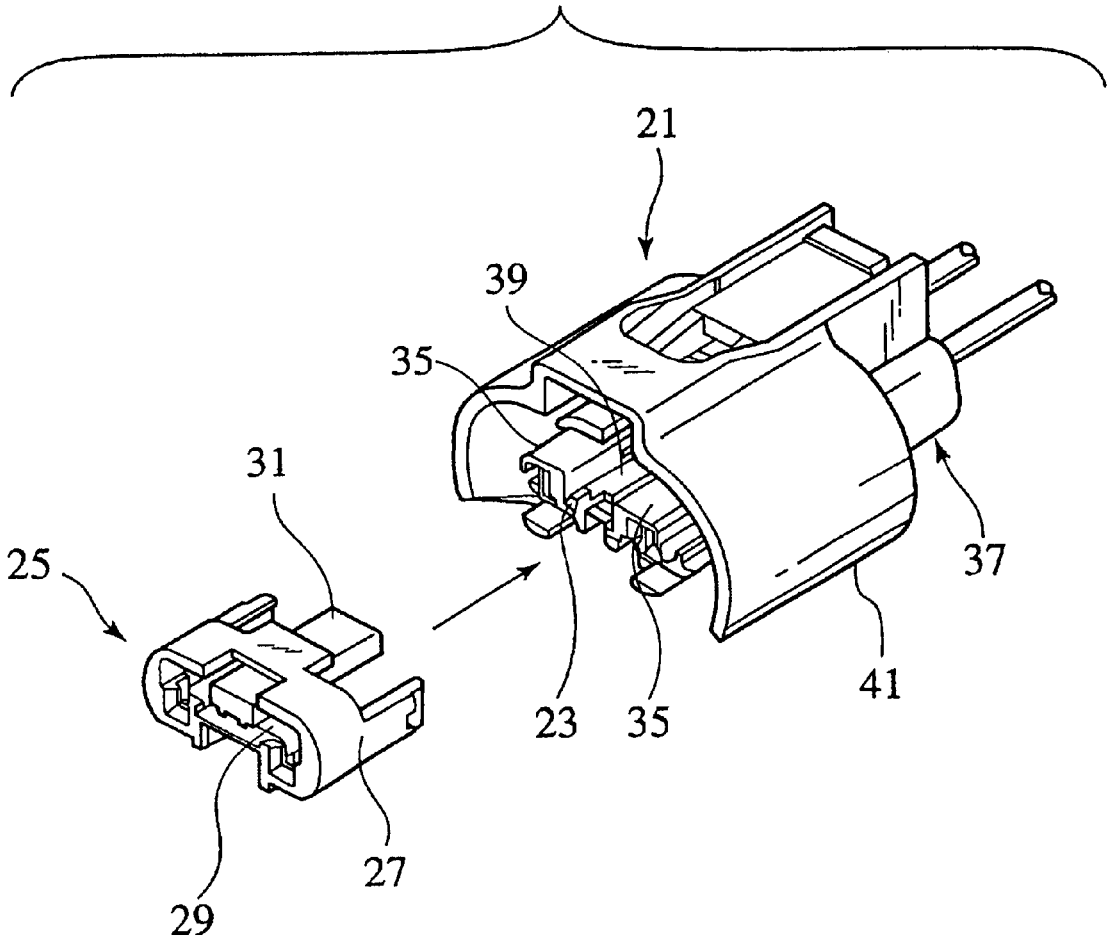
FIG. 1 is a perspective view of a front holder and a connector housing body according to a first embodiment of the present invention.
Figure 2:
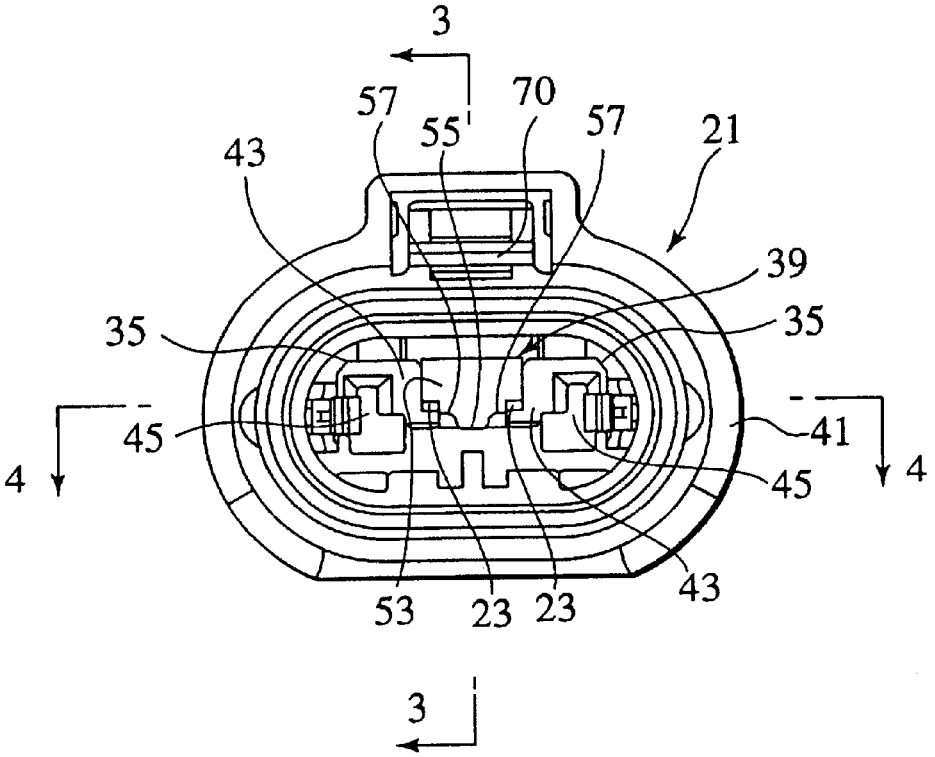
FIG. 2 is a front view of the front holder and the connector housing body of the first embodiment of the invention.
Figure 5:
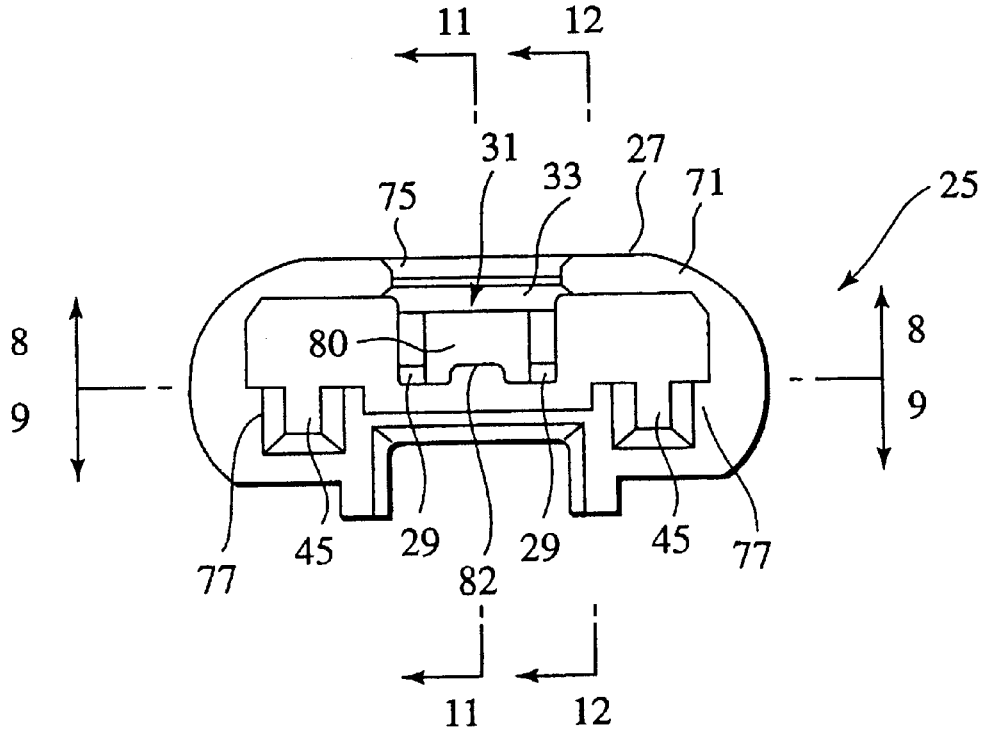
FIG. 5 is a front view of the front holder of the first embodiment of the invention.
Figure 6:
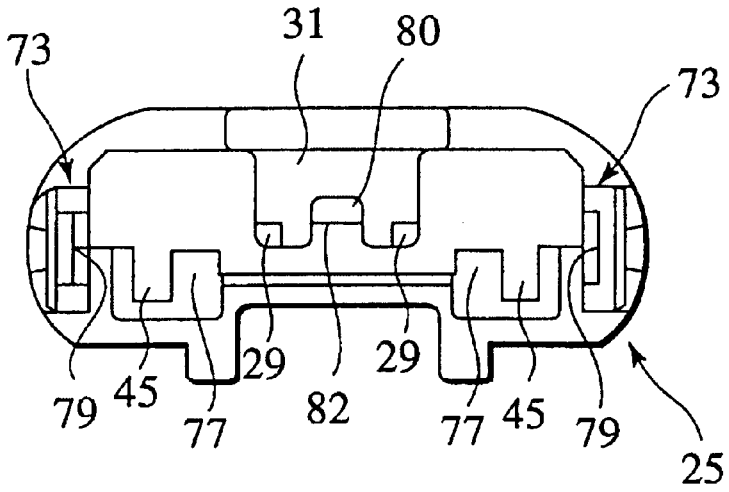
FIG. 6 is a rear view of the front holder of the first embodiment of the invention.
Figure 7:
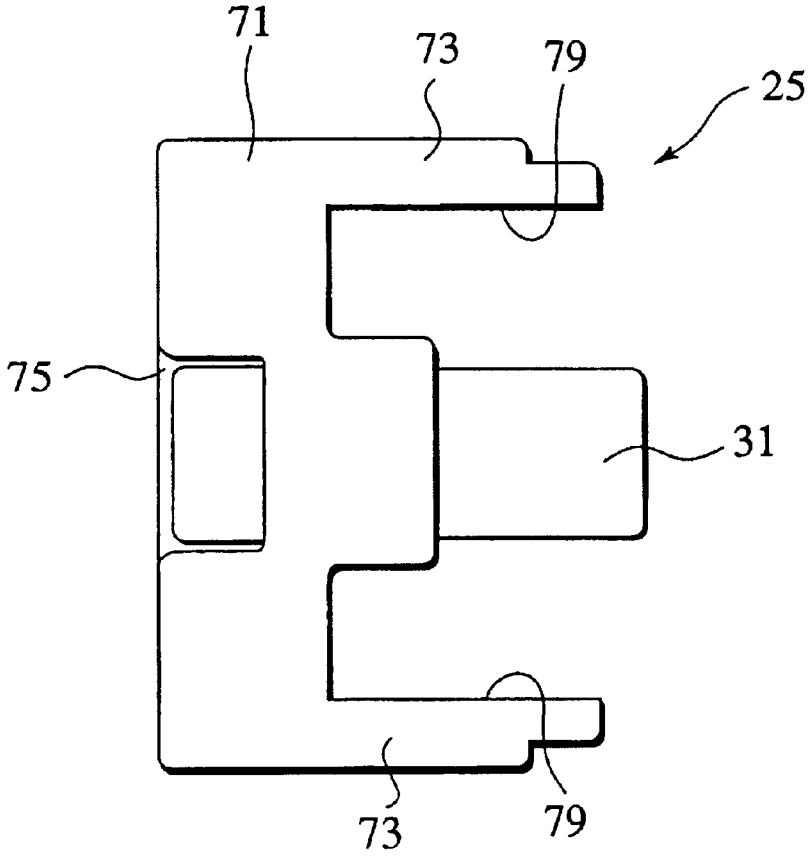
FIG. 7 is a plan view of the front holder of the first embodiment of the invention.

As shown in FIGS. 1, 2 and 5, a retaining structure of a front holder and a connector housing of the first embodiment of the present invention comprises a housing body 21 having a retaining portion 23, a housing body 27 of a front holder 25, a holding arm 31 having a retaining projection 29 engaged with the retaining portion 23 in a state where the retaining projection 29 is retained to the retaining portion 23, and a flexible connection portion 33 for rockably supporting the holding arm 31 on the housing body 27 at a leading end side of the flexible connection portion 33 in an inserting direction of the later-described front holder 25 into the housing body 21. In this retaining structure of the front holder, if the front holder 25 is inserted into the housing body 21, the retaining projection 29 and the retaining portion 23 are engaged with each other.

As shown in FIGS. 1 to 4, the housing body 21 comprises a plurality of terminal accommodating chambers 35 formed in one end of the housing body 21, a plurality of terminal inserting portion 37 formed in the other end of the housing body 21, a holder connecting portion 39 formed between the terminal accommodating chambers 35, and a fitting hood portion 41 for covering an outer periphery of each of the terminal accommodating chambers 35.

The terminal accommodating chambers 35 are cylindrically shaped and they are connected to each other. As shown in FIG. 2, each of the terminal accommodating chambers 35 is formed at its end surface 43 with an insertion port 45 into which a terminal of a mating housing is inserted. A lower side of the end surface 43 is notched.

Figure 4:
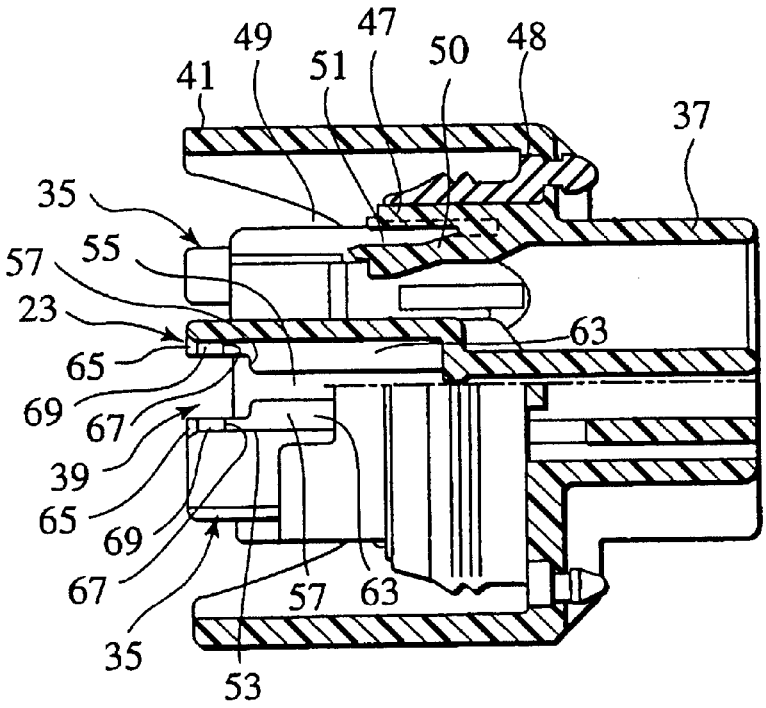
FIG. 4 is a sectional view of the housing body of the first embodiment of the invention taken along a line 4—4 in FIG. 2.

Further, as shown in FIG. 4, each the terminal accommodating chamber 35 is provided with an opening 49 passing through a sidewall 47 from its inner peripheral side to its outer peripheral side, and a packing member 48 is tightly connected to the outer peripheral surface. The terminal accommodating chambers 35 include retaining pieces 50 projecting inward from the sidewall 47.

The retaining piece 50 is of long plate-like shape, one end thereof is formed into an integral shape in one piece with the sidewall 47 of the terminal accommodating chamber 35 thereon, and the other end is a free end in the terminal accommodating chamber 35. The retaining piece 50 extends along the sidewall 47, the free end is directed to one end of the housing body 21, and the free end is engaged with the terminal accommodated in the terminal accommodating chamber 35. The retaining piece 50 has a gap between an outer surface 51 and an inner peripheral surface of the sidewall 47.

The housing body 21 is formed in its one end with the terminal accommodating chambers 35 and in the other end with the plurality of terminal inserting portions 37.

The terminal inserting portions 37 are formed cylindrically, and extend from the terminal accommodating chambers 35 respectively. When the terminals each provided on an end of an electric wire and having a waterproofing plug are inserted into the terminal accommodating chambers 35 respectively, the waterproofing plug comes into tight contact with the inner peripheral surface and makes between the inner peripheral surface and the electric wire waterproof.

Figure 3:
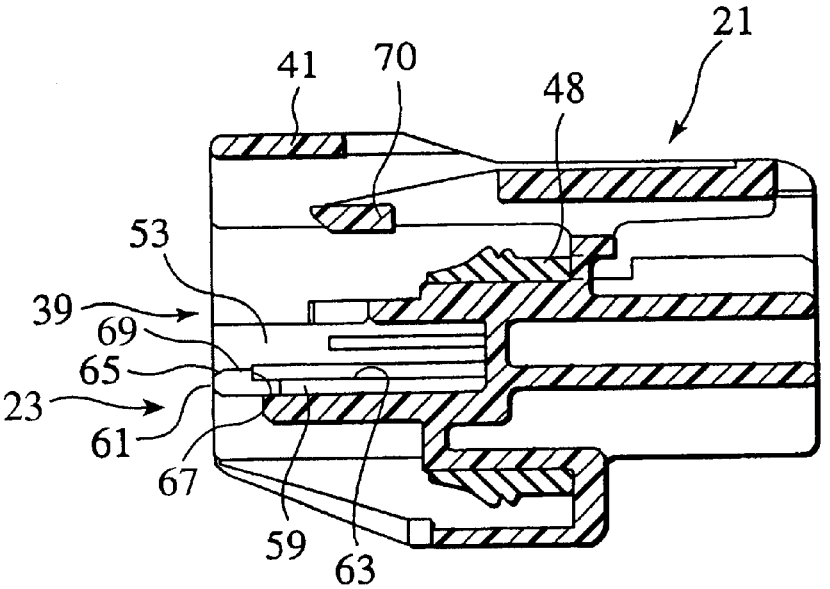
FIG. 3 is a sectional view of the housing body of the first embodiment of the invention taken along a line 3—3 in FIG. 2.

As described above, the housing body 21 is provided with the holder connecting portion 39 between the terminal accommodating chambers 35. As shown in FIGS. 2 to 4, the holder connecting portion 39 comprises a holding arm-accommodating portion 53 and a plurality of retaining portions 23 provided in the holding arm-accommodating portion 53. The holding arm-accommodating portion 53 extends along the terminal accommodating chamber 35 and formed from an end of a fitting surface with respect to the mating housing body of the terminal accommodating chamber 35 toward the other end of the housing body 21. The holding arm-accommodating portion 53 has substantially the same cross sectional shape as that of a later-described holding arm, and the holding arm-accommodating portion 53 accommodate the holding arm 31 in a state where the front holder 25 is retained to the housing body 21. The holding arm-accommodating portion 53 is provided with a shoulder 57 on an end of a fitting surface with respect to the mating housing body of a bottom surface 55.

As shown in FIGS. 3 and 4, the holding arm-accommodating portion 53 is provided at its opposite sides of the bottom surface 55 in its widthwise direction with projections 59 formed along a longitudinal direction. These projections 59 are formed such that and end surface 61 is flush with the end surface 43 of the terminal accommodating chamber 35. The retaining portion 23 is provided on an upper surface 63 of the projection 59.

Each of the retaining portions 23 is in a form of a projection, and projects upward from an end on the side of the fitting surface with the mating housing body of the projections 59. Each of the retaining portions 23 comprises a tapered surface 65 formed on the side of the fitting surface with the mating housing body, an engaging surface 67 formed on a surface opposed to the tapered surface 65, and an upper surface 69 for connecting the tapered surface 65 and the engaging surface 67 with each other. The tapered surface 65 is a slant surface, one side of the tapered surface 65 is integrally formed on the upper surface 69 of the retaining portion 23, and the other end is disposed near an interior of the holding arm-accommodating portion 53 from the end surface 61 of the projections 59 with respect to the one side.

As described above, the engaging surface 67 formed on a surface opposed to the tapered surface 65 is formed on a plane in a direction substantially perpendicular to the longitudinal direction of the projection 59.

The upper surface 69 connecting the engaging surface 67 and the tapered surface 65 to each other connects the other side of the tapered surface 65 and a projecting side of the engaging surface 67 on a plane. Each of the upper surfaces 69 is formed in a direction substantially parallel to an upper surface 63 of the projection 59, and the upper surface 69 is the strongest portion of the retaining portion 23.

The fitting hood portion 41 is formed cylindrically, and the fitting hood portion 41 has a gap therein and covers an outer periphery of the terminal accommodating chamber 35. The fitting hood portion 41 has a rock arm 70, and when the mating housing body is fitted, the rock arm 70 is engaged with the mating housing body. The front holder 25 is retained to the housing body 21 formed in this manner.

As shown in FIG. 5, the front holder 25 of this embodiment comprises the housing body 27, the holding arm 31 having the retaining projection 29 engaged with the retaining portion 23 in a state where the retaining projection 29 is retained to the housing body 21, and the flexible connection portion 33 for rockably supporting the holding arm 31 on the housing body 27 at the leading end side of the flexible connection portion 33 in the inserting direction of the front holder 25 into the housing body 21.

As shown in FIGS. 5 to 12, the housing body 27 comprises a peripheral wall 71 and walls 73 integrally formed on the peripheral wall 71. The peripheral wall 71 is formed cylindrically, and is provided at its upper portion with a notch 75 notched from one side to the other side so that when the later-described holding arm 31 rocks, the holding arm 31 does not interfere. The peripheral wall 71 is provided a lower end surface 77 forming a lower side of the insertion port 45 of the terminal accommodating chamber 35 in a state where the front holder 25 is retained to the housing body 21. The peripheral wall 71 covers outer peripheries of the plurality of terminal accommodating chambers 35 with a fitting surface with respect to the mating housing body in a state where the front holder 25 is retained to the housing body 21. Each of the walls 73 is integrally formed on the other side of the peripheral wall 71.

Each of the walls 73 is of long plate-like shape. One of the walls 73 is integrally formed on the peripheral wall 71, and the other one projects toward a front side of the front holder 25 in an inserting direction to the housing body 21. The walls 73 close the openings 49 of the terminal accommodating chambers 35 in a state where the front holder 25 is retained to the housing body 21, and inner surfaces 79 come into contact with outer surfaces 51 of the retaining pieces 50 in the terminal accommodating chambers 35, thereby restricting motions of the retaining pieces 50.

Figure 13:
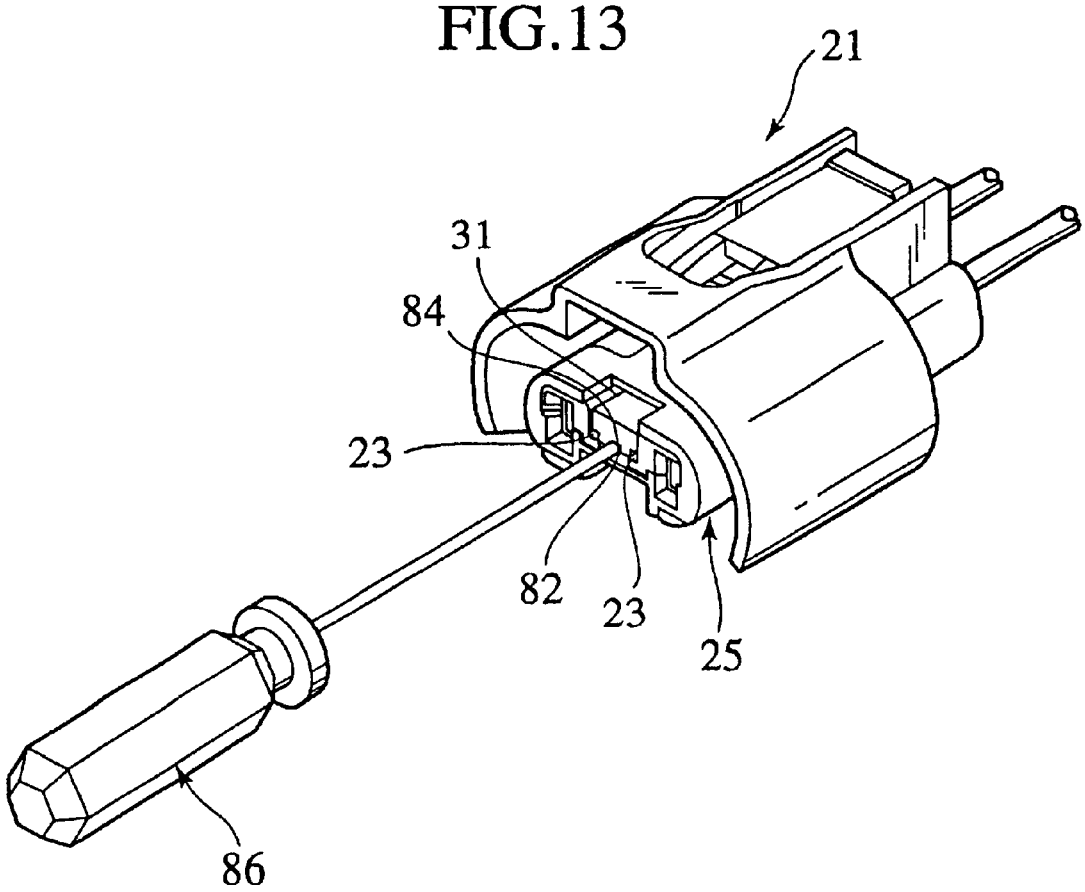
FIG. 13 is a perspective view of the housing body and the front holder of the first embodiment of the invention.

The holding arm 31 is of long plate-like shape, its rear end in the fitting direction of the front holder 25 into the housing body 21 in the longitudinal direction is located slightly in front of one end of the peripheral wall 71 in the inserting direction, and the other end of the holding arm 31 projects from the other end of the peripheral wall 71 toward the front end in the inserting direction. As shown in FIGS. 5, 6, 8 and 11, the holding arm 31 has a recessed step 82 on an end surface 80 of the holding arm 31 in the fitting direction of the front holder 25 into the housing body 21. In a state where the front holder 25 is retained to the housing body 21, a space 84 is formed between the step 82 and the housing body 21 as shown in FIG. 13. The holding arm 31 has the retaining projections 29 downwardly projecting from opposite sides of in a widthwise direction of an inner surface 81.

Figure 8:
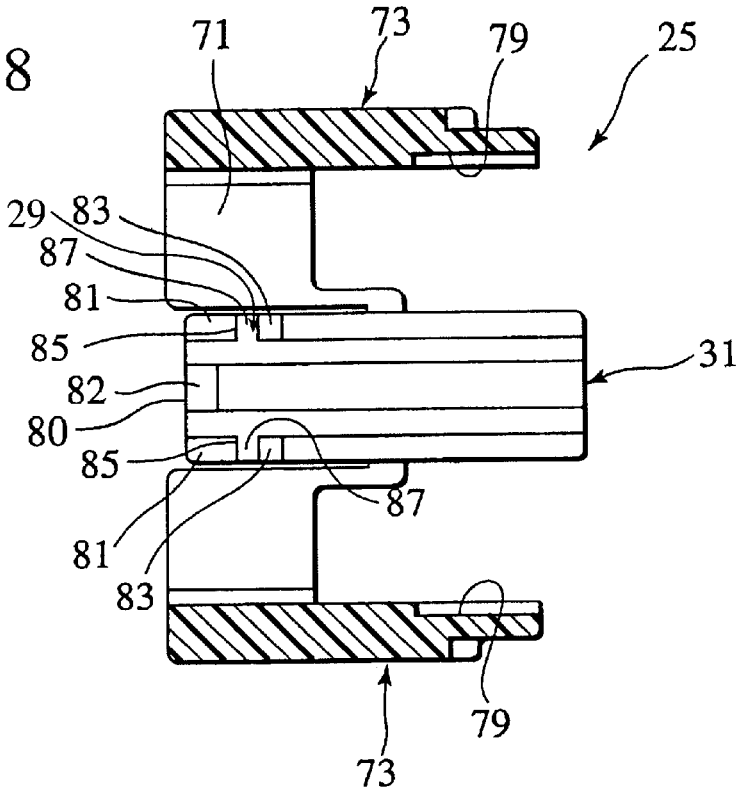
FIG. 8 is a sectional view of the front holder of the first embodiment of the invention taken along a line 8—8 in FIG. 5.
Figure 9:
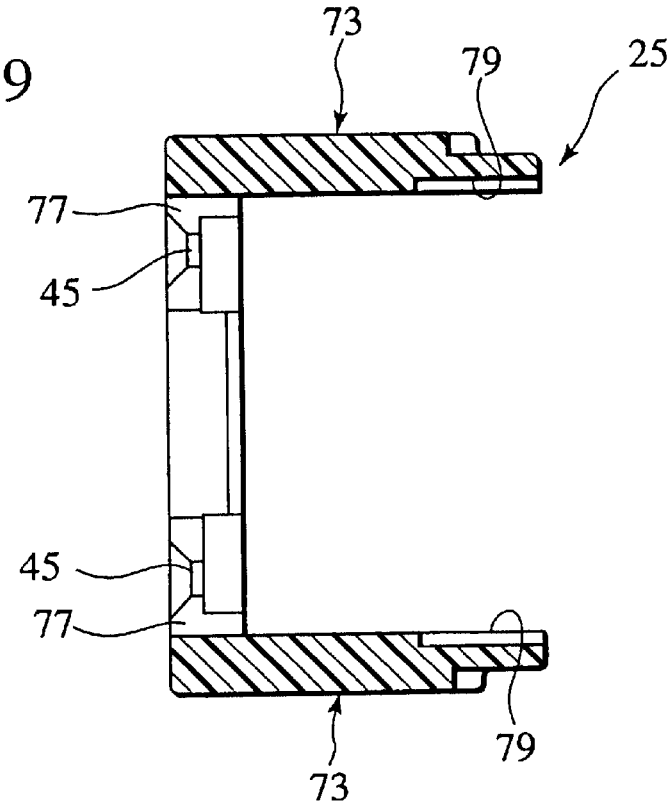
FIG. 9 is a sectional view of the front holder of the first embodiment of the invention taken along a line 9—9 in FIG. 5.
Figure 10:
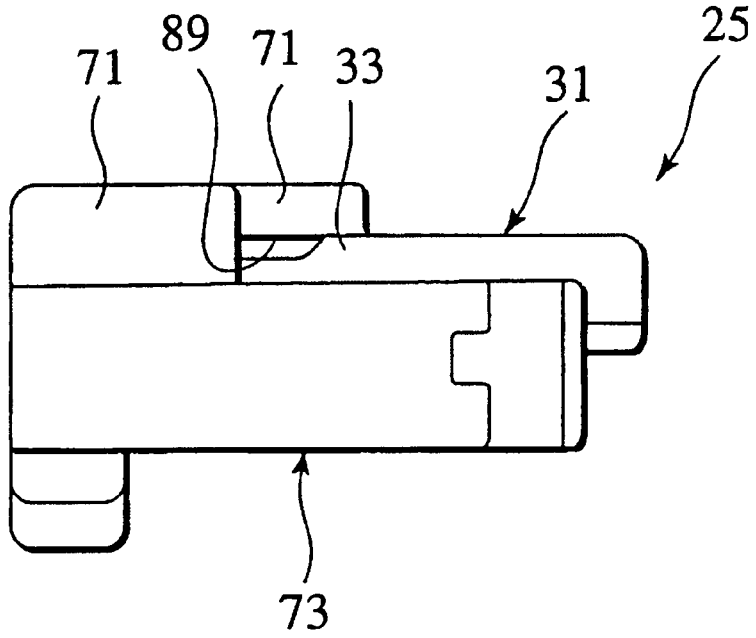
FIG. 10 is a side view of the front holder of the first embodiment of the invention.
Figure 11:
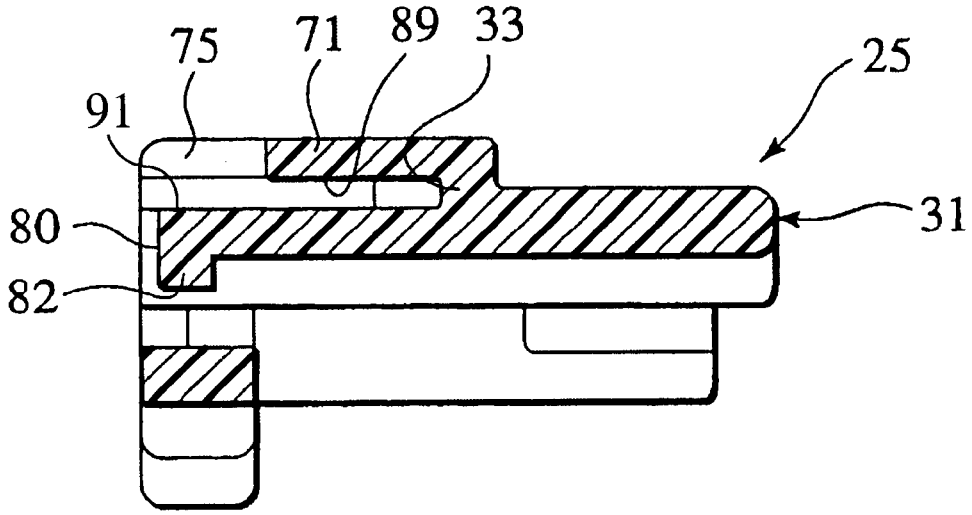
FIG. 11 is a sectional view of the front holder of the first embodiment of the invention taken along a line 11—11 in FIG. 5.
Figure 12:
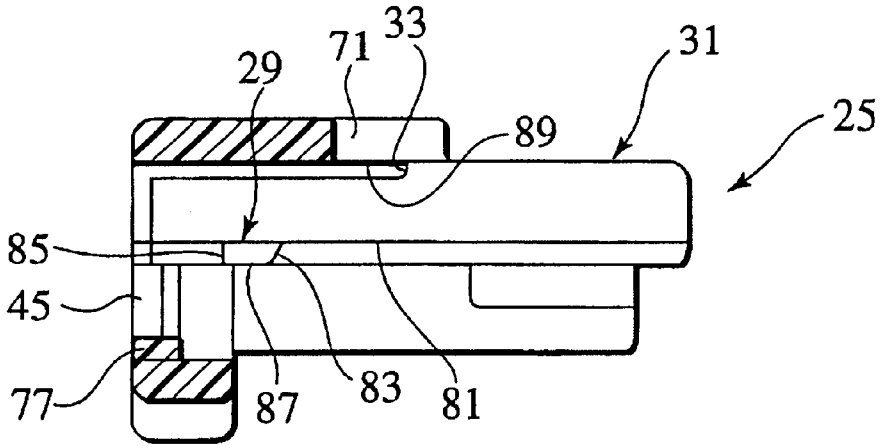
FIG. 12 is a sectional view of the front holder of the first embodiment of the invention taken along a line 12—12 in FIG. 5.

As shown in FIGS. 5 to 12, each of the retaining projections 29 is located in front of a rear end of the holding arm 31 in inserting direction of the front holder 25 into the housing body 21 slightly toward this inserting direction. A projecting height of the retaining projection 29 from an inner surface of the holding arm 31 is almost the same as that of the retaining portion 23 of the housing body 21 from the projections 59. As shown in FIGS. 8 and 12, each the retaining projection 29 comprises a slide guide surface 83 provided on a front end of the front holder 25 in the inserting direction of the front holder 25 into the housing body 21, an abutment surface 85 formed on a rear end of the retaining projection 29 in the inserting direction, and a lower surface 87 connecting the slide guide surface 83 and the abutment surface 85 with each other.

The slide guide surface 83 is a flat slant surface, one side of the slide guide surface 83 is connected to an inner surface of the holding arm 31, and the other side of the slide guide surface 83 is connected to a rear end side of the front holder 25 in the inserting direction thereof into the housing body 21.

The abutment surface 85 opposed to the slide guide surface 83 of the retaining projection 29 is flat, and perpendicular to the inserting direction of the front holder 25 into the housing body 21 substantially at right angles.

The above-described lower surface 87 is flat, and connects the other side of the slide guide surface 83 and the projecting side of the abutment surface 85. The lower surface 87 extends substantially in parallel to the bottom surface 55 of the holding arm-accommodating portion 53, and the lower surface 87 is the lowest portion of the retaining projection 29.

As shown in FIGS. 10 to 12, the flexible connection portion 33 rockably supporting the holding arm 31 on the housing body 27 connects an inner peripheral surface 89 of an upper portion of the other side of the peripheral wall 71 and an intermediate portion of an outer side surface 91 of the holding arm 31 to each other. The flexible connection portion 33 supports the holding arm 31 on a front end side of the flexible connection portion 33 in the inserting direction of the front holder 25 into the housing body 21 with respect to the retaining projection 29.

When the front holder 25 is to be retained to the housing body 21, the front holder 25 is inserted into the housing body 21 to bring the retaining projection 29 and the retaining portion 23 into engagement with each other.

When the front holder 25 is to be inserted into the housing body 21, the other end of the holding arm 31 in its longitudinal direction is aligned to the holding arm-accommodating portion 53 of the housing body 21. Then, if the front holder 25 is inserted into the housing body 21, the sidewall 47 forming the opening 49 of the terminal accommodating chamber 35 and the wall 73 of the front holder 25 are engaged with each other, and the slide guide surface 83 of the retaining projection 29 and the tapered surface 65 of the retaining portion 23 are abutted against each other.

In this state, if the front holder 25 is further inserted into the housing body 21, since the slide guide surface 83 of the retaining projection 29 pushes the tapered surface 65 of the retaining portion 23, the holding arm 31 receives its reaction force. Therefore, the holding arm 31 rocks around the flexible connection portion 33 as a fulcrum such that portion of the holding arm 31 closer to the end surface 80 is displaced upward.

If the front holder 25 was inserted to a position where the front holder 25 is retained to the housing body 21, the retaining projection 29 climbs over the retaining portion 23, the flexible connection portion 33 is restored by its own resiliency, and the holding arm 31 is accommodated in the holding arm-accommodating portion 53 as a whole.

As a result, the abutment surface 85 of the retaining projection 29 and the engaging surface 67 of the retaining portion 23 are engaged with each other, and the front holder 25 is retained to the housing body 21. At that time, the upper surface 69 of the retaining portion 23 and the inner surface 81 of the holding arm 31 are abutted against each other, and the lower surface 87 of the retaining projection 29 and the upper surface 63 of the projections 59 are abutted against each other.

Each the wall 73 closes the opening 49, the inner surface 79 comes into contact with the outer surface 51 of the retaining piece 50 in the terminal accommodating chamber 35 to restrict the movement of the retaining piece 50, thereby retaining the terminal accommodated in the terminal accommodating chamber 35.

In a state where the front holder 25 is retained to the housing body 21, if a force in a direction to release the retaining state between the front holder 25 and the housing body 21 is applied, the abutment surface 85 of the retaining projection 29 abuts the engaging surface 67 of the retaining portion 23, and the retaining projection 29 receives a reaction force from the retaining portion 23. Therefore, a force in a direction to displace a portion of the holding arm 31 closer to the end surface 80 around the flexible connection portion 33 as a fulcrum is applied to the holding arm 31.

At that time, since the inner surface 81 is in abutment against the upper surface 69 of the retaining portion 23 and the lower surface 87 of the retaining projection 29 is in abutment against the upper surface 63 of the projections 59 of the housing body 21, displacement of the holding arm 31 is restricted and rocking motion is prevented. Thus, the retaining state between the front holder 25 and the housing body 21 is reliably maintained.

When the front holder 25 is to be detached from the housing body 21, the engagement between the retaining portion 23 and the retaining projection 29 is released by a jig 86 as shown in FIG. 13.

At that time, one end of the jig 86 is inserted into the space 84. Next, the other end of the jig 86 is displaced downward around an end of the bottom surface 55 on the side of the fitting surface with respect to the housing body as a fulcrum. Subsequently, jig 86 pressurize an end surface of the recessed step 82 and connects the flexible connection portion 33 As a result, a portion of the holding arm 31 on the side of the end surface 80 is upwardly displaced and rocked around the flexible connection portion 33 as the fulcrum, and the engagement between the retaining projection 29 and the retaining portion 23 is released. In this state, a force in a direction releasing the retained state of the retaining projection 29 to the housing body 21 is applied to the front holder 25, and the front holder 25 is detached from the housing body 21.

As described above, according to the retaining structure of the front holder of this embodiment, when a force in a direction releasing the retained state of the retaining projection 29 to the housing body 21 is applied to the front holder 25 in the state,where the front holder 25 is retained to the housing body 21, the end surface 80 tried to be displaced downward around the flexible connection portion 33 as the fulcrum. At that time, the inner surface 81 is in abutment against the upper surface 69 of the retaining portion 23 and the lower surface 87 of the retaining projection 29 is in abutment against the upper surface 63 of the projections 59, the displacement of the holding arm 31 is restricted and the rocking motion can be prevented, and the retained state between the front holder 25 and the housing body 21 can reliably be maintained.

Thus, it is possible to lower the rigidity of the flexible connection portion 33, and the holding arm 31 can rock easily when the front holder 25 is to be inserted into the housing body 21 and when the front holder 25 is to be detached from the housing body 21.

Therefore, a force required for inserting the front holder 25 into the housing body 21 is reduced, which makes it easy to retain the front holder 25 to the housing body 21. Further, the front holder 25 can easily be detached from the housing body 21, and the front holder 25 can be prevented from being damaged.

In the state where the front holder 25 is retained to the housing body 21, even if a force in the direction releasing the engagement between the front holder 25 and the housing body 21 is applied, since the abutment surface 85 abuts against the engaging surface 67 to prevent engagement between the front holder 25 and the housing body 21 from being released, the engagement is reliably maintained.

Further, when the front holder 25 is to be inserted into the housing body 21, the slide guide surface 83 of the retaining projection 29 slides on the retaining portion 23 and the rocking motion of the holding arm 31 is guided, the retaining portion 23 and the retaining projection 29 can be engaged with each other only by inserting the front holder 25. Therefore, the front holder 25 can be retained to the housing body 21 easier.

According to the retaining structure of the front holder of the present embodiment, it is possible to insert the jig into the space 84 to rock the holding arm 31 in the state where the front holder 25 is retained to the housing body 21. Therefore, the front holder 25 can easily be detached from the housing body 21.

What is claimed is:

1. A retaining structure of a front holder to a connector housing comprising;

a connector housing including a holder connecting portion having a retaining portion; and a front holder, including;

a holding arm having a retaining projection; and a flexible connection portion for supporting said holding arm so that said retaining projection can be engaged with said retaining portion;

wherein said flexible connection portion supports said holding arm on a front end of said flexible connection portion in an inserting direction of said front holder into said connector housing with respect to said retaining projection; and said retaining projection is configured to be engaged with said retaining portion and is configured to be accommodated within said holder connecting portion in a state where said front holder is retained to said connector housing.

2. A retaining structure of a front holder and a connector housing according to claim 1, wherein said retaining projection is formed in a direction perpendicular to said inserting direction of said front holder into said connector housing; and said retaining projection includes an abutment surface which abuts against said retaining portion in a state where said retaining projection is retained to said retaining portion.

3. A retaining structure of a front holder and a connector housing according to claim 1, wherein said retaining projection includes a slide guide surface which slides on said retaining portion to guide a rocking motion of said holding arm when said front holder is inserted into said connector housing.

4. A retaining structure of a front holder and a connector housing according to claim 1, wherein in a state where said front holder is retained to said connector housing, a space is formed between said connector housing and a rear end of said holding arm in said inserting direction inserting said front holder into said connector housing so that a jig can be inserted from said rear end into said space to disengage said retaining projection from said retaining portion.

5. A retaining structure of a front holder and a connector housing according to claim 1, wherein said connector housing comprises a fitting hood portion covering an outer periphery of said holder connecting portion.

* * * * *